US005319887A

United States Patent [19]

Walz et al.

[11] Patent Number: 5,319,887

[45] Date of Patent: Jun. 14, 1994

[54] HAND SANDER

[75] Inventors: Heinz Walz, Stuttgart; Peter Stierle, Waldenbuch; Albert Ruess, Filderstadt, all of Fed. Rep. of Germany

[73] Assignee: Robert Bosch GmbH, Stuttgart, Fed. Rep. of Germany

[21] Appl. No.: 773,898

[22] PCT Filed: Oct. 26, 1989

[86] PCT No.: PCT/DE89/00686

§ 371 Date: Oct. 29, 1991

§ 102(e) Date: Oct. 29, 1991

[87] PCT Pub. No.: WO91/00163

PCT Pub. Date: Jan. 10, 1991

[30] Foreign Application Priority Data

Jun. 27, 1989 [DE] Fed. Rep. of Germany ..... 3921003

[51] Int. Cl.[5] ..... B24B 23/06

[52] U.S. Cl. ..... 51/170 EB

[58] Field of Search ..... 51/170 R, 170 EB, 135 R, 51/148

[56] References Cited

U.S. PATENT DOCUMENTS 4,177,609 12/1979 Rameckers et al. ..... 51/170 EB 4,584,797 4/1986 Wanninkhof ..... 51/170 EB

FOREIGN PATENT DOCUMENTS 0007172 1/1980 European Pat. Off. .

3844359 7/1990 Fed. Rep. of Germany ... 51/170 EB

*Primary Examiner*—Roscoe V. Parker

*Attorney, Agent, or Firm*—Michael J. Striker

[57] ABSTRACT

A hand belt sander has a housing, a drive roller and a deflecting roller both rotatably supported in the housing, the deflecting roller being arranged at a distance from the drive roller movable between a substantially axes-parallel arrangement and out of the axes-parallel arrangement with the drive roller, an endless sanding belt guided along the rollers, a guide plate located in the housing and carrying a control plate with an end for receiving the deflecting roller and being displaceable together with the control plate, a lever arm sensing a position of the sanding belt by a stop part and acting on the position of the sanding belt, a swivel arm around which the lever arm is swivelable and which extends perpendicular relative to the guide plate. The swivel arm sits in the guide plate. The control plate is swivelable around the swivel axle together with the ends and extends toward the guide roller so as to form the swivel arm in a one-piece element, and also carries the stop part.

7 Claims, 1 Drawing Sheet

HAND SANDER

BACKGROUND OF THE INVENTION

The present invention is directed to a hand belt sander. More particularly, it relates to a hand belt sander which has a housing for receiving a motor, a drive roller and a deflecting roller, an endless sanding belt guided along the deflecting roller and over a sanding plate, and a guide plate which has a control plate with a fork-shaped end for receiving the deflecting roller and arranged to be displaceable with the latter.

A hand belt sander of the generic type comprising drive and deflecting rollers and an automatic belt running centering means is described in EP-PS 7172. A feeler with a lever system for swiveling the deflecting roller is supported at the housing of the known hand belt sander. The support is located near the deflecting roller.

Hand belt sanders have the peculiarity that the circulating sanding belt wanders laterally, depending on the force and direction of application. The belt running centering means is provided in order to ensure that the center of the sanding belt accurately conforms to the center of the drive or deflecting roller running surface. As soon as the sanding belt moves transversely relative to the running direction, one of its edges strikes the feeler which is situated a short distance therefrom. The feeler acts on the deflecting roller via the lever system. The deflecting roller is moved out of the position in which it is parallel to the axis of the drive roller in such a way that the belt is steered again into the center of the roller circumference.

Disadvantages of the known belt running centering means consist in its costly construction which comprises a plurality of articulations and is susceptible to disturbances from vibration and dirt, as well as the high wear on the lever system for the belt running centering means and on the sanding belt to be centered. A further disadvantage consists in the necessary adjustment of the known belt running centering means depending, for example, on elongation of the sanding belt caused by wear or as a result of the differences in length between different sanding belts when exchanging the latter.

SUMMARY OF THE INVENTION

Accordingly, it is an object of the present invention to provide a hand belt sander which avoids the disadvantages of the prior art and is a further improvement over the existing hand belt sanders.

In keeping with these objects and with others which will become apparent hereinafter, one feature of the present invention resides, briefly stated, in a hand belt sander of the above mentioned type in which a swivel axle which supports a lever arm for sensing a position of the sanding belt sits in the guide plate, the control plate is fillable around the swivel axis together with the fork-shaped end and is lengthened toward the drive roller so as to form the swivel arm in one piece and also to carry a stop part.

When the hand belt sander is designed in accordance with the present invention, it has the advantage of a simple, robust and reliably operating construction with reduced wear of the centering device as well as of the sanding belt. The service life of the sanding belt is prolonged considerably. The work quality which can be achieved with hand belt sanders is improved. Work interruptions due to failure of the automatic belt running centering means and the manual adjustment which is subsequently necessary are eliminated. Particular advantages of the invention result from the compact, planar lever arrangement of the belt running centering means without support at the housing with only a single swivel axle. The invention meets the object of providing a sensitive and robust belt running centering means for a hand belt sander with few parts which are simple to produce, operate in a reliable manner and eliminate the need for adjustment after exchanging the sanding belt.

In accordance with another feature of the present invention the stop part is arranged at the outer edge of the sanding belt closely adjacent to the drive roller and the sanding plate.

Still another feature of the present invention is that the deflecting roller carries at least one O-ring on its circumference on the side of the lever arm.

Finally, the deflecting roller can carry a circumferentially extending, formed-in flange on its circumference on the side of the lever arm.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
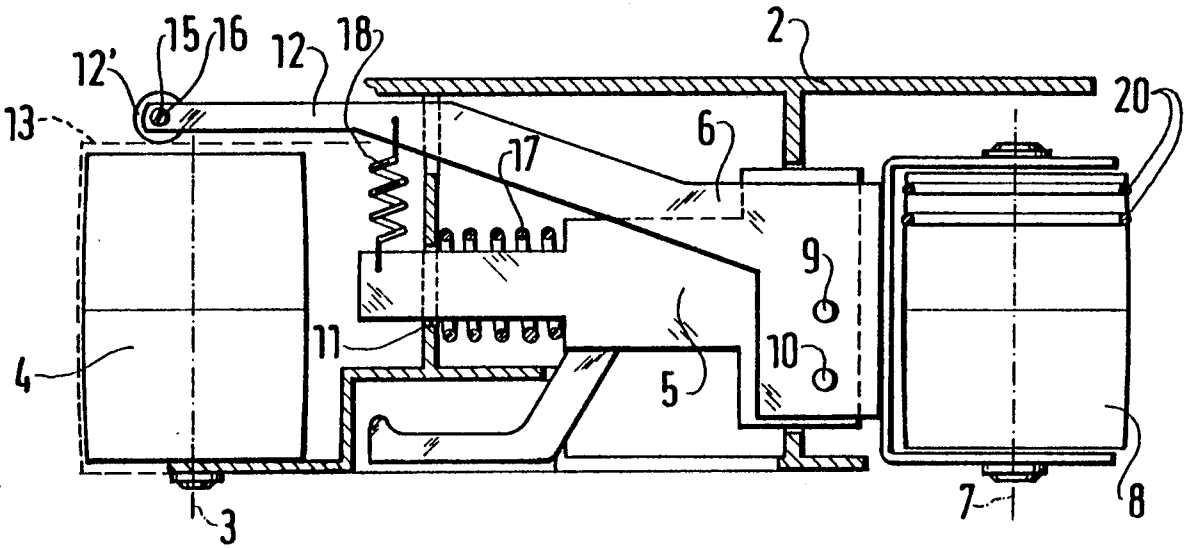
FIG. 1 shows a view of a hand belt sander from below.

FIG. 1 shows a hand belt sander 1 with a motor which is not shown in detail. The hand belt sander 1 has a housing 2 which receives an axle 3 with a drive roller 4 on the one hand and a guide plate 5 on the other hand. A control plate 6 with a fork-shaped end for receiving an axle 7 of a deflecting roller 8 is supported on this guide plate 5. The control plate 6 is swivelably held at the guide plate 5 via a swivel axle 9—or 10, as desired—which is constructed as a joint. The guide plate 5 is guided in guide grooves 11 of the housing 2 so as to be displaceable transversely relative to the axles 3, 7.

The side of the control plate 6 remote of the fork-shaped end ends in a lever arm 12. The latter carries a stop part 12' in the shape of a stop roller which is positioned near the drive roller 4 immediately adjacent to the provided movement path of an outer edge 13 of a sanding belt 14 which is guided on the drive roller 4 and deflecting roller 8 and along a sanding plate 19 shown in FIG. 2. The stop part 12' is supported at the lever arm 12 so as to be rotatable around a clamping screw 15 by means of an eccentric pin 16 and is adjustable relative to the outer edge 13 via the eccentric pin 16. A pressure spring 17 is supported on one side in the area of the guide grooves 11 at the housing 2 and on the other side in a step-shaped area of the guide plate 5. In addition to the pressure spring 17, another pressure spring 18 can be supported between the end of the guide plate 5 on the drive roller side and the lever arm 12. The deflecting roller 8 eccentrically supports two O-rings 20 on the side of the stop part 12' on its circumference.

Figure 2:
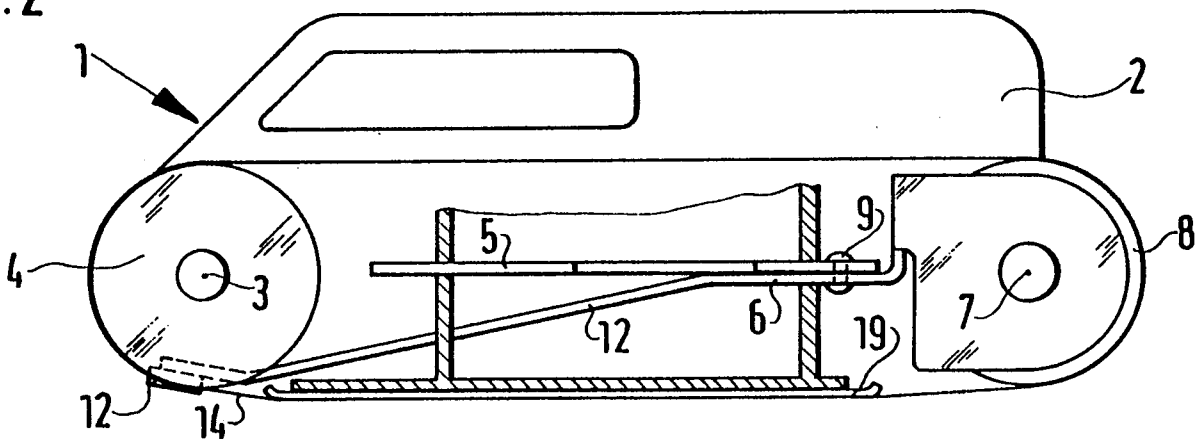
FIG. 2 shows a side view of the latter.

The side view of the hand belt sander 1 shown in FIG. 2 illustrates the position of the lever arm 12 with the stop part 12' for the sanding belt 14 and the sanding plate 19. Moreover, the position of the guide plate 5 is shown at approximately half the height of the drive and deflecting rollers 4, 8 and the position of the motor is shown above this.

Figure 3:
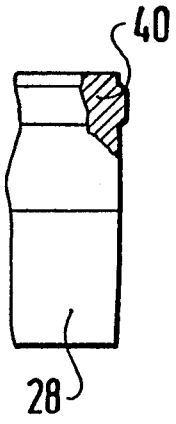
FIG. 3 shows a separate embodiment example of the deflecting roller.

The embodiment example in FIG. 3 shows a guide roller 28 carrying a flange 40 laterally at its circumference instead of the two O-rings 20 according to FIG. 1, the flange 40 being formed into the roller material.

The belt running centering means and operations with respect to the latter at the hand belt sander 1 are described in the following: The motor drives the drive roller 4. The latter transmits the circulating movement required for sanding to the sanding belt 14 and accordingly to the deflecting roller 8, 28. The side of the hand belt sander 1 on which the sanding plate 19 is located is placed on a surface to be sanded and is held there. The sanding belt 14 sliding over this surface causes the surface abrasion.

During transverse movements of the hand belt sander 1 when sanding, the sanding belt 14 can move transversely on the rollers 4, 8 and 28, respectively, e.g. to the left with reference to the viewing direction. In so doing, the left-hand outer edge 13 strikes the stop part 12' of the lever arm 12 and moves the latter to the left. This movement to the left causes a movement of the control plate 6 in the same direction around the swivel axle 9 and 10, respectively. As a result of this movement, the fork-shaped end of the control plate 6 with the deflecting roller 8, 28 swivels to the right around the swivel axle 9 and 10, respectively. The sanding belt 14 is accordingly guided to the right with the deflecting roller 8 and 28, respectively, in the opposite direction of its transverse movement. As soon as the sanding belt 14 occupies its corrected position, the stop part 12 is released. Consequently, the swivel arm 12 swivels to the right around the swivel axle 9 and 10, respectively, with the control plate 6, and the fork-shaped end of the control plate 6 is accordingly moved back around the swivel axle 9 and 10, respectively, to the left into the initial position.

The axles 3, 7 are adjusted in such a way that there is a defined slight oversteering tendency of the sanding belt 14 directed toward the left-hand side, so that the sanding belt 14 constantly swings transversely slightly toward and away from the stop part 12'. This oversteering tendency can be varied by means of the dimensioning of the additional pressure spring 18 or by means of the arrangement of the O-rings 20 or the flange 40 at the deflecting roller 8 and 28, respectively, or by means of the alternative, eccentric swivel axle 10. If the transverse movement of the sanding belt 14 increases due to external influences, e.g. when cross-sanding with the hand belt sander, the restoring effect described above also increases.

A transverse movement of the sanding belt toward the right, as seen in the viewing direction, is automatically compensated for as a result of the oversteering tendency toward the left.

The pressure springs 17, 18 are means for tightening the sanding belt 14 as required in operation and effect an application of force of the deflecting roller 8 and 28, respectively, away from the drive roller 4.

The eccentric pin 16, by means of which the stop part 12' can be adjusted parallel to the axles 3, 7, makes it possible to displace the sanding belt 14 into a different centering position, particularly toward the right as seen in the viewing direction. The outer edge 13 of the sanding belt 14 accordingly projects out over the right-hand outer edge of the hand belt sander or sanding plate 19. This enables a particularly exact and sensitive sanding of uneven surfaces or grooves in a flush manner.

The position of the stop part 12' closely adjacent to the drive roller 4 near the sanding plate 19 brings about a particularly responsive regulating mode, since the transverse displacement of the sanding belt 14 first begins in this area. The inertia of the control circuit is accordingly clearly reduced, since the transverse displacement reverses itself automatically as soon as it occurs.

It will be understood that each of the elements described above, or two or more together, may also find a useful application in other types of constructions differing from the types described above.

While the invention has been illustrated and described as embodied in a hand sander, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hand belt sander, comprising a housing; a drive roller and a deflecting roller both rotatably supported in said housing, said deflecting roller being arranged at a distance from said drive roller movably between a substantially axes-parallel arrangement and out of the axes-parallel arrangement with said drive roller; an endless sanding belt guided along said rollers; a guide plate which is located in said housing and carries a control plate with an end for receiving said deflecting roller and which is displaceable together with said control plate; a lever arm sensing a position of said sanding belt by a stop part and acting on the position of said sanding belt, a swivel axial around which said lever arm is swivelable and which extends perpendicular relative to said guide plate, said swivel axial sitting in said guide plate, said control plate being swivelable around said swivel axis together with said end and extending toward said drive roller so as to form a swivel arm in a one-piece element and also carrying said stop part.

2. A hand belt sander as defined in claim 1, and further comprising a sanding plate, said endless sanding belt being guided over said sanding plate as well.

3. A hand belt sander as defined in claim 1; and further comprising at least one spring which acts on said guide plate.

4. A hand belt sander as defined in claim 2, wherein said sanding belt has an outer edge which is closely adjacent to said drive roller and said sanding plate, said stop part being arranged at said outer edge of said sanding belt which is closely adjacent to said drive roller and said sanding plate.

5. A hand belt sander as defined in claim 1, wherein said deflecting roller has at least one O-ring on its circumference at a side of said lever arm.

6. A hand belt sander as defined in claim 1, wherein said deflecting roller carries a circumferentially extending flange on its circumference at a side of said lever arm.

7. A hand belt sander as defined in claim 6, wherein said flange is formed of one piece with said deflecting roller.

* * * * *